US012680435B2

(12) United States Patent
Almani et al.

(10) Patent No.: US 12,680,435 B2
(45) Date of Patent: Jul. 14, 2026

(54) FORMATION BREAKDOWN PRESSURE NEAR WELLBORES

(71) Applicant: Saudi Arabian Oil Company, Dhahran (SA)

(72) Inventors: Tameem Almani, Dammam (SA); Khaqan Khan, Dhahran (SA); Mohammad H. Altwaijri, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 391 days.

(21) Appl. No.: 18/366,354

(22) Filed: Aug. 7, 2023

(65) Prior Publication Data

US 2025/0052141 A1 Feb. 13, 2025

(51) Int. Cl.

| | |
|---|---|
| ***E21B 43/26*** | (2006.01) |
| ***E21B 47/022*** | (2012.01) |
| ***E21B 49/00*** | (2006.01) |

(52) U.S. Cl.

CPC ..... *E21B 43/26* (2013.01); *E21B 47/022* (2013.01); *E21B 49/006* (2013.01)

(58) Field of Classification Search

CPC ..... E21B 43/26; E21B 47/022; E21B 49/006
See application file for complete search history.

(56) References Cited

U.S. PATENT DOCUMENTS

| | | | |
|---|---|---|---|
| 10,221,649 | B2 | 3/2019 | Shahri et al. |
| 10,597,982 | B2 | 3/2020 | Shahri et al. |
| 10,982,536 | B2 | 4/2021 | Kirane et al. |
| 11,255,184 | B1 | 2/2022 | Xia et al. |
| 11,675,106 | B2 | 6/2023 | Almani et al. |
| 2016/0291181 | A1 | 10/2016 | Sinha |
| 2022/0259960 | A1 * | 8/2022 | Xia ..... G01V 20/00 |
| 2022/0381946 | A1 | 12/2022 | Almani et al. |

FOREIGN PATENT DOCUMENTS

CN 107939380 A * 4/2018 ..... E21B 47/06

OTHER PUBLICATIONS

Zhu et al., "A prediction of breakdown pressure from damaged deviated well" IOP Conf. Series: Earth and Environmental Science 675 (2021) 012174 (Year: 2021).*

(Continued)

*Primary Examiner* — John C Kuan
(74) *Attorney, Agent, or Firm* — Fish & Richardson P.C.

(57) ABSTRACT

Among other things, methods and systems are described for calculating formation breakdown pressures. A method involves determining, during hydraulic fracturing operations, a pore pressure for a wellbore; determining a poroelastic stress for the wellbore using a poroelastic stress equation and based on the pore pressure; determining, during the hydraulic fracturing operations, a breakdown pressure upper bound for the wellbore; applying, during the hydraulic fracturing operations, a stress correction on the breakdown pressure upper bound based on whether the wellbore is an open hole wellbore or a cemented liner wellbore; and determining, during the hydraulic fracturing operations, a breakdown pressure for the wellbore based on the stress-corrected upper bound breakdown pressure for the wellbore.

17 Claims, 9 Drawing Sheets

(56) References Cited

OTHER PUBLICATIONS

Advanced Engineering Mathematics, Greenberg, Prentice-Hall Inc. Upper Saddle River, N.J., 1998, 1348 pages.
Ding et al., "The Research on Influence of Unloading on Borehole Stability in Clay-Rich Shale Formation," The Open Petroleum Engineering Journal, Aug. 2017, 10: 204-219, 16 pages.
Fatahi, "Simulation of Hydraulic Fracture Propagation Interacted with Natural Fractures," PhD Dissertation, Curtin University, Nov. 2016, 188 pages.
Foundations of Applied Mathematics, Greenberg, Prentice-Hall Inc. Englewood Cliffs, N.J., 1978, p. 423-434, 9 pages.
Greenberg "Foundations of Applied Mathematics" discloses on p. 430 Bessel function of first and second kind and order v are given by (22.93) and (22.94); (1978).
Haimson et al., "In Situ Stress Determination at Great Depth by Means of Hydraulic Fracturing," 11th Symposium on Rock Mechanics. W. Somerton, Society of Mining Engineers of AIME, 1970, 26 pages.
Ito et al., "Physical Background to the Breakdown Pressure in Hydraulic Fracturing Tectonic Stress Measurements," Int. J. Rock Mech. Min. Sci. & Geomech. Abstr., 1991, 28(4):285-293, 9 pages.
Ito, "Effect of pore pressure gradient on fracture initiation in fluid saturated porous media: Rock," Engineering Fracture Mechanics, 2008, 75:1753-1762, 10 pages.
Khorram et al., "Modeling and Simulation of Oil Well Stimulation by High Power Ultrasonic Irradiation", Acta Acustica United With Acustica, Jun. 2017, 103(3):411-420, 10 pages.
Medlin et al., "Laboratory Investigation of Fracture Initiation Pressure and Orientation," presented at the SPE-AIME 51st Annual Fall Technical Conference and Exhibition, New Orleans, Oct. 3-6, 1976, 16 pages.
Numerical Analysis, Burden and Faires, Brooks/Cole, Ninth ed., Boston, MA, 2011, 895 pages.
Petroleum Related Rock Mechanics, 2nd ed., 2008, Elsevier, 515 pages.
Poroelasticity, vol. 27, Hassanizadeh (ed)., 2016, 893 pages.
Rice et al., "Some Basic Stress Diffusion Solutions for Fluid-Saturated Elastic Porous Media with Compressible Constituents," Reviews of Geophysics and Space Physics, May 1976, 14(2):227-241, 15 pages.
Schmitt et al., "Poroelastic effects in the determination of the maximum horizontal principal stress in hydraulic fracturing tests—A proposed breakdown equation employing a modified effective stress relation for tensile failure," Int. J. Rock Mech. Min. Sci. & Geomech. Abstr. Dec. 1989, 26(6):499-506, 8 pages.
Yang et al., "On Approximating the Modified Bessel Function of the Second Kind," Journal of Inequalities and Applications, Article ID 41, Feb. 2017, 8 pages.
Wang, "Theory of Linear Poroelasticity with Applications to Geomechanics and Hydrogeology," Princeton Series in Geophysics, Dec. 3, 2000, pp. 201, 202, 259, and 260, 4 pages total.

* cited by examiner

FORMATION BREAKDOWN PRESSURE NEAR WELLBORES

TECHNICAL FIELD

The present disclosure describes systems and methods for determining formation breakdown pressure near wellbores.

BACKGROUND

Well stimulation is a well intervention technique in which several operations are performed on a well to increase the well's hydrocarbon production. Hydraulic fracturing is an example well stimulation technique in which the bedrock formation is fractured by injecting highly pressurized fluids. In this technique, different drilling fluids are pumped into targeted completion zones to stimulate the well. The success of a hydraulic fracturing operation depends on an accurate estimation of the formation breakdown pressure prior to the actual stimulation job being performed.

Among other things, an accurate estimation of the breakdown pressure value is important for determining how much horsepower is required on-site for creating adequate fracture geometry and successful placement of stimulation materials into the created fracture. Overstimulation can lead to an inappropriate selection of the well completion type and expenditure loss, while under-stimulation can result in operational failures. Accurately calculating breakdown pressure value is one of the significant challenges in hydraulic fracturing operations, especially for deviated and horizontal wells in tight sandstone formations and compressional in-situ stress regimes.

SUMMARY

Existing techniques for accurately calculating the formation breakdown pressure are deficient or limited, especially for deviated and horizontal wellbores.

This disclosure describes systems and methods for implementing a workflow for accurately calculating formation breakdown pressures, e.g., for deviated and horizontal wellbores. The workflow considers a generalized stress model for an arbitrary wellbore orientation and azimuth. The workflow employs the theory of poroelasticity to compute pore pressures and poroelastic stresses numerically. The workflow then uses the computed pore pressures and poroelastic stresses to accurately calculate the breakdown pressure.

As described in more detail below, the calculated breakdown pressure takes into account the underlying fluid (e.g., hydrocarbon) and solid (e.g., rock formation) physical parameters when computing the breakdown pressure at a particular depth and wellbore orientation. The underlying flow and mechanics parameters include an initial wellbore pressure, fracturing fluid compressibility and viscosity, in-situ stresses in the formation, formation strength, permeability of the rock formation, porosity of the rock formation, minimum and maximum horizontal stresses, inclination and azimuth angles of the wellbore orientation, the tensile strength of the formation rock, a poroelastic parameter, the Poisson ratio of the rock formation, and the wellbore radius.

One aspect of the subject matter described in this specification may be embodied in a method that involves receiving input parameters for computing a breakdown pressure for a wellbore in a formation, the input parameters comprising an inclination angle of the wellbore from a vertical axis, and an azimuth angle of the wellbore relative to a maximum horizontal stress direction, at a particular depth; determining, during hydraulic fracturing operations, a pore pressure for the wellbore based on a time duration, an injection fluid compressibility, and a poroelastic parameter; determining a poroelastic stress for the wellbore using a poroelastic stress equation and based on the pore pressure determined for the wellbore, an empirical parameter, a pore pressure, the poroelastic parameter, a tensile strength of rock, and a Poisson ratio; determining, during the hydraulic fracturing operations, a breakdown pressure upper bound for the wellbore based on a minimum horizontal stress and a maximum horizontal stress for the wellbore, an overburden vertical stress for the wellbore, the inclination angle of the wellbore, the azimuth angle of the wellbore, and a wellbore circumferential angle; applying, during the hydraulic fracturing operations, a stress correction on the breakdown pressure upper bound for the wellbore based on whether the wellbore is an open hole wellbore or a cemented liner wellbore; and determining, during the hydraulic fracturing operations, a breakdown pressure for the wellbore based on the stress-corrected upper bound breakdown pressure for the wellbore, the poroelastic stress for the wellbore, and the pore pressure for the wellbore.

The previously described implementation is implementable using a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium. These and other embodiments may each optionally include one or more of the following features.

In some implementations, the method further involves determining, based at least on the breakdown pressure, a horsepower level needed for creating a fracture geometry used in the hydraulic fracturing operations; determining a successful placement of stimulation materials for the hydraulic fracturing operations; determining, based at least on the breakdown pressure, a pressure rating of tubulars required for fracturing treatment; and completing the hydraulic fracturing operations using the horsepower level, the successful placement of the stimulation materials, and one or more tubulars having the determined pressure rating of the tubulars required for the fracturing treatment.

In some implementations, determining the pore pressure for the wellbore involves determining the pore pressure for the wellbore using a Stehfest method equation that is a function of the time duration, a distance from the wellbore in a radial direction, the injection fluid compressibility, and the poroelastic parameter.

In some implementations, the Stehfest method equation is further a function of a modified Bessel function of a second kind of order 0.

In some implementations, the poroelastic stress is further based on a Composite Simpson's Rule for numerical integration.

In some implementations, the input parameters further include an initial wellbore pressure, a rock permeability, a rock porosity, an injection fluid compressibility, an injection fluid viscosity, a Poisson ratio, a wellbore radius, and a distance from the wellbore in a radial direction, at a particular depth.

In some implementations, an initial value for the distance from the wellbore in a radial direction is two and a half the wellbore radius.

In some implementations, the wellbore is one of: (i) a deviated and horizontal wellbore, or (ii) a vertical wellbore.

In some implementations, an initial value for the time duration is a time at which the formation is expected to break after a slurry injection.

In some implementations, an initial value for the time duration is 1000 seconds.

In some implementations, the wellbore is either open hole or cement lined.

Existing techniques for calculating breakdown pressure either compute the breakdown pressure using approximations to analytical solutions (which do not take into account the underlying physical parameters), or use pure numerical solutions (e.g., the Finite Element Method and the Distinct Element Method). Thus, the existing techniques for computing breakdown pressure can be categorized into two main methods or approaches: (i) a first approach that relies on crude approximations of analytical solutions, and (ii) a second approach that relies on pure numerical solutions.

One of the disadvantages of the first approach is that it does not take into account the effects of key physical parameters, such as, rock porosity and permeability, and fracturing fluid compressibility and viscosity. These are key physical parameters that can significantly affect the breakdown pressure. In addition, these parameters can vary (even within the same wellbore), which makes such approximations not reliable. Moreover, the first approach cannot take into account the orientation of the wellbore in an arbitrary setting. Further, approximations to analytical solutions rely heavily on empirical parameters that require extensive resources to calculate (e.g., to be calibrated).

The second approach relies merely on numerical solutions, such as the use of the Distinct Element Method and the Finite Element Method. This approach is computationally expensive and requires both the flow and mechanics problems to be solved in a coupled manner. Therefore, this approach can only provide approximate solutions to the underlying physical equations. Additionally, this approach is still not fully developed. For example, only recently have phase field methods been proposed to simulate hydraulic fracture initiation and propagation. These methods are computationally expensive and rely on simplified models of the actual physical problem.

The disclosed workflow is a hybrid approach that combines the advantages of analytical solutions and numerical techniques and avoids the dependence on any empirical parameters, and theoretically derives an expression of the breakdown pressure. Further, the disclosed workflow works for any arbitrary wellbore orientation by taking into account the corresponding inclination and azimuth angles of the wellbore. Furthermore, eliminating empirical parameters from the workflow removes the need to calibrate these parameters, which adds to the practically of the workflow since parameter calibration is not always possible due to the lack of data. In addition, the disclosed workflow employs numerical techniques that can overcome numerical instability issues when implementing analytical solutions. For example, the disclosed workflow utilizes a Laplace Transform solution to solve for pore pressure and does not invert the Laplace Transform analytically. Rather, the workflow does so numerically to avoid numerical instability issues. In particular, the disclosed workflow solves the underlying partial differential equation analytically using the Laplace Transform, then inverts the obtained solution (in the Laplace Transform domain) numerically using the Stehfest Method. Thus, the workflow computes the breakdown pressure using a rigorously derived theoretical expression.

The disclosed workflow also eliminates the dependence on empirical parameters, which are often associated with approximations to analytical solutions. Removing empirical parameters from the workflow eliminates the need to calibrate these parameters. Doing so adds to the robustness, accuracy, and efficiency (e.g., computing and processing efficiency) of the workflow. Also, the disclosed workflow computes breakdown pressure as a function of underlying physical parameters. This approach results in a more accurate estimate of the breakdown pressure compared to existing techniques. Moreover, incorporating the physical parameters into the workflow is done using a hybrid analytical and numerical approach, which enhances the accuracy and computational efficiency of the disclosed workflow.

The details of one or more embodiments of these systems and methods are set forth in the accompanying drawings and the description below. Other features, objects, and advantages of these systems and methods will be apparent from the description and drawings, and from the claims.

BRIEF DESCRIPTION OF THE DRAWINGS

Like reference symbols in the various drawings indicate like elements.

DETAILED DESCRIPTION

This disclosure describes systems and methods for implementing a formation breakdown pressure calculation workflow. The workflow considers an arbitrary wellbore orientation and azimuth, uses a generalized stress model, and calculates the formation breakdown pressure as a function of the underlying flow and mechanics parameters. Additionally, this disclosure describes actions that can be performed based on the calculated breakdown pressure.

The disclosed workflow is an extension of a workflow described in U.S. Pat. No. 11,675,106, entitled "Predicting formation breakdown pressure for hydrocarbon recovery applications," which is incorporated herein by reference. The workflow described in U.S. Pat. No. 11,675,106 considers vertical wells only. This disclosure first describes the workflow for calculating the breakdown pressure for a vertical wellbore. The disclosure then adapts the vertical wellbore workflow to a generalized workflow for all other types of wells, e.g., deviated and horizontal wells.

Figure 1:
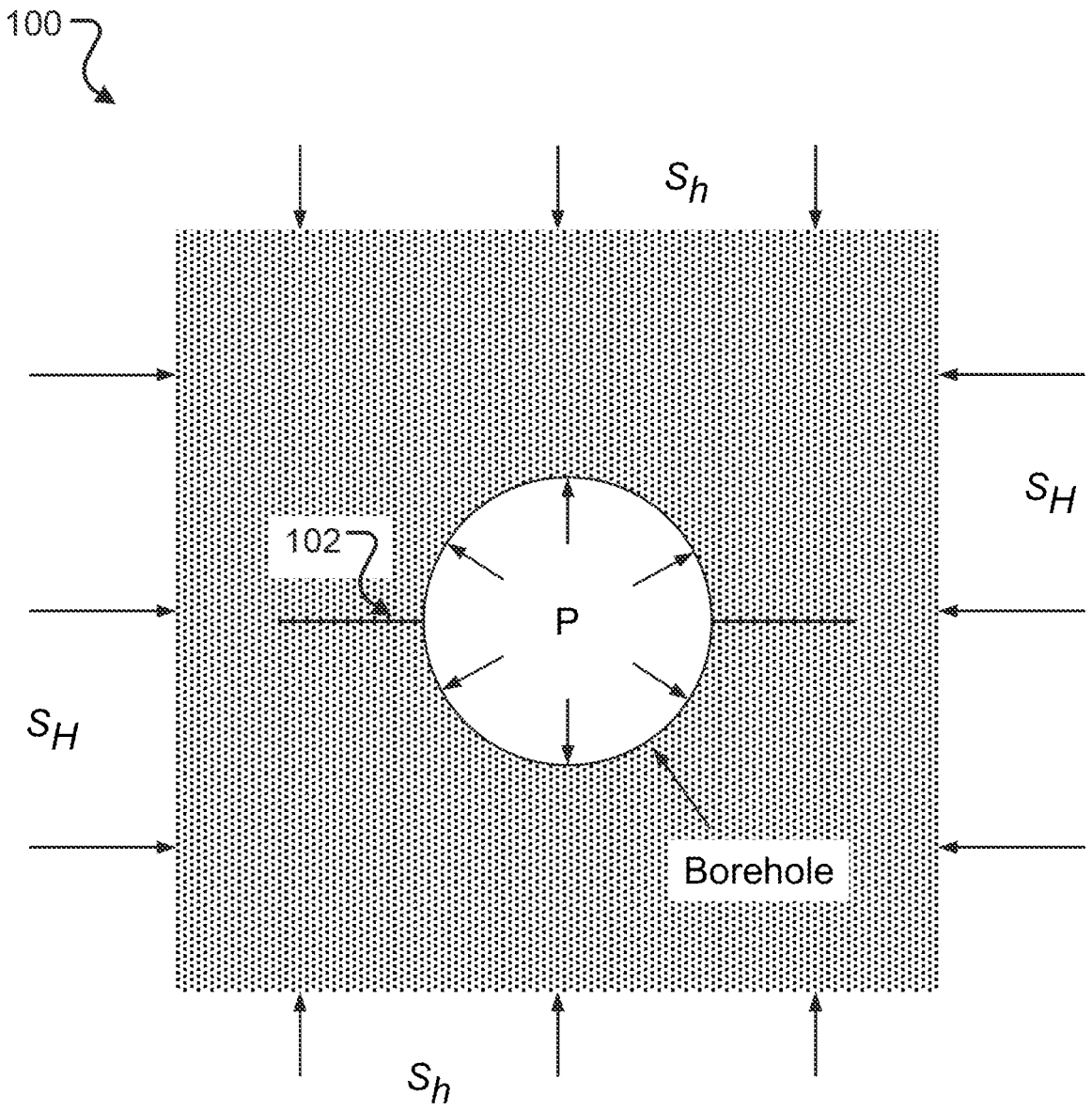
FIG. 1 illustrates a cross-sectional view of an example of a vertical borehole subject to in-situ stresses and an induced fracture during hydraulic fracturing, according to some implementations.

FIG. 1 illustrates a cross-sectional view of an example of a vertical borehole 100 subject to in-situ stresses and an induced fracture 102 during hydraulic fracturing, according to some implementations. As shown in FIG. 1, the in-situ stresses include a minimum horizontal stress $S_h$ and a maximum horizontal stress $S_H$, where $|S_H|>|S_h|$.

A breakdown pressure ($P_f$) is the pressure at which fracture initiation occurs. Mathematically, the breakdown pressure can be defined as the pressure at which the maximum tensile stress reaches the tensile strength of the rock ($\sigma_f$) at the wellbore. This is expressed in Equation (1) as:

$$s_\theta^{(1)} + s_\theta^{(2)} + s_\theta^{(3)} = \sigma_f - P_p. \tag{1}$$

In Equation (1), for the vertical well case, $$S_\theta^{(1)}$$

is a circumferential stress induced by tectonic stresses (e.g., the two horizontal stresses $S_h$ and $S_H$), $$S_\theta^{(2)}$$

is the stress induced by a borehole pressure $P_w$, and $$S_\theta^{(3)}$$

is the stress induced by the fluid permeation into the formation, which is known as the poroelastic stress. Poroelastic stress is a function of the pore pressure $P_p$ and other underlying physical parameters.

A two-dimensional (2D) cylindrical coordinate system (r, θ) is assumed when solving Equation (1) around the vertical wellbore 100. At r=a, which is the wellbore radius, if Equation (1) is satisfied, then it can be assumed that $P_f=P_w$. In terms of the minimum and maximum horizontal stress $S_h$ and $S_H$, $$S_\theta^{(1)} \text{ and } S_\theta^{(2)}$$

can be calculated using Equations (2) and (3), respectively:

$$S_\theta^{(1)} = \frac{S_H + S_h}{2}\left(1 + \frac{a^2}{r^2}\right) - \frac{S_H - S_h}{2}\left(1 + 3\frac{a^2}{r^2}\right)\cos 2\theta. \tag{2}$$

$$S_\theta^{(2)} = \frac{a^2}{r^2}P_w. \tag{3}$$

The 2D (r, θ) coordinate system can be rotated such that the r-axis is aligned with the orientation of the maximum horizonal stress $S_H$. In this case, $$S_\theta^{(1)}$$

has a maximum value when θ=0, π, which reduces Equation (2) to:

$$S_\theta^{(1)} = \frac{S_H + S_h}{2}\left(1 + \frac{a^2}{r^2}\right) - \frac{S_H - S_h}{2}\left(1 + 3\frac{a^2}{r^2}\right). \tag{4}$$

Since the breakdown pressure is being calculated at the wellbore radius, r=a, the expression for $$S_\theta^{(1)}$$

is further reduced to:

$$S_\theta^{(1)} = 3S_h - S_H. \tag{5}$$

Similarly, since r=a, Equation (3) is reduced to:

$$S_\theta^{(2)} = P_w. \tag{6}$$

Equations (1)-(6) can be used to derive an expression for a breakdown pressure upper bound in the vertical well case. Note that in the upper bound case, $P_p=0$. Thus, the upper bound breakdown pressure is calculated as:

$$P_{f-Upper\ Bound} = \sigma_f - (3S_h - S_H). \tag{7}$$

The breakdown pressure lower bound can be computed as:

$$P_{f-Lower\ Bound} = \frac{P_{f-Upper\ Bound}}{1 - 2\alpha\left(\frac{1-2\nu}{1-\nu}\right)}. \tag{8}$$

In Equation (8), α is the Biot poroelastic coefficient and ν is the Poisson ratio. Note that tensile strength of the rock ($\sigma_f$) has a predetermined value.

The breakdown pressure can be calculated as a function of the pore pressure, $P_p$, and the poroelastic stress, $$S_\theta^{(3)}.$$

Specifically, the pore pressure $P_p$ can be computed using Equation (9) as:

$$P_p = \frac{\ln(2)}{t}\sum_{i=1}^{n}\left(c_i \frac{P_0 K_0\left(\sqrt{\frac{i\ln(2)}{tc}}\,r\right)}{\frac{i\ln(2)}{t}K_0\left(\sqrt{\frac{i\ln(2)}{tc}}\,a\right)}\right). \tag{9}$$

In Equation (9), $P_0$ is the initial wellbore pressure, t is the time at which the fracture opens, a is the wellbore radius, r is the radial distance away from the wellbore, and $K_0(x)$ is a modified Bessel function of the second kind of order 0. The parameter $c_i$ can be calculated using Equation (10) as:

$$c_i = (-1)^{i+\frac{n}{2}} \sum_{k=\left\lceil \frac{i+1}{2} \right\rceil}^{min(i,\frac{n}{2})} \left( \frac{k^{\frac{n}{2}}(2k)!}{\left(\frac{n}{2}-k\right)!\, k!\, (k-1)!\, (i-k)!\, (2k-i)!} \right). \tag{10}$$

Further, the parameter c can be calculated using Equation (11) as:

$$c = \frac{K}{\mu \phi c_f}. \tag{11}$$

In Equation (11), Ø is the rock porosity, $c_f$ is the injection fluid compressibility, K is the rock permeability, and μ is the injection fluid viscosity.

Once the pore pressure $P_p$ is determined, the poroelastic stress can be calculated as:

$$S_\theta^{(3)} = \alpha \left( \frac{1-2\nu}{1-\nu} \right) \left( \frac{1}{r^2} \int_{r_0}^{r} P_p \rho \, d\rho - P_p \right). \tag{12}$$

Then, the breakdown pressure can be calculated as:

$$P_f = \sigma_f - (3S_h - S_H) - S_\theta^{(3)} - P_p. \tag{13}$$

In some implementations, Equation (13) can be extended to a generalized stress model to cover the case of deviated and horizontal wells. Specifically, for an arbitrary borehole, a generalized stress model is used to determine the principal stresses affecting the wellbore.

Figure 2:
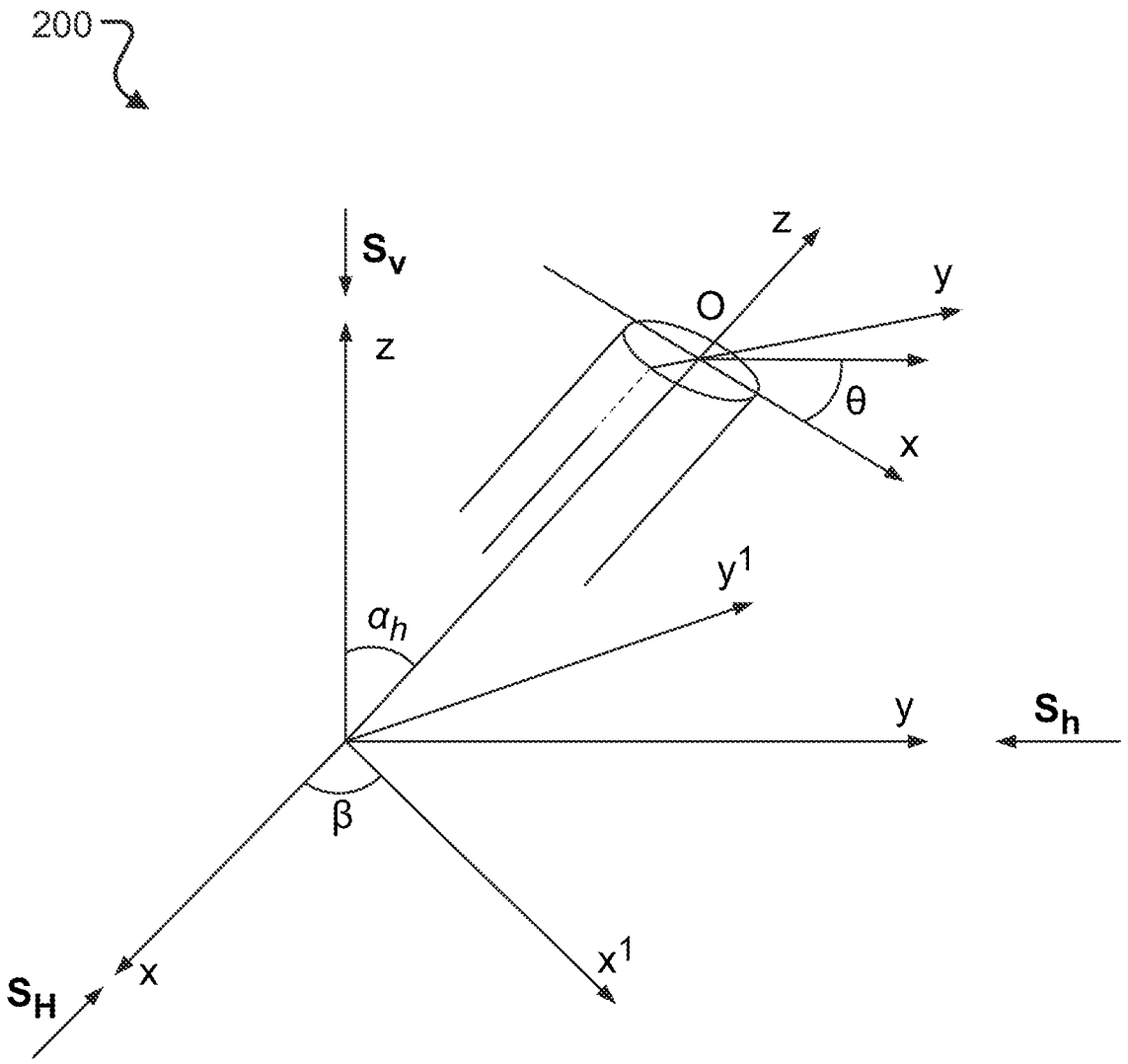
FIG. 2 illustrates a schematic of stress transformation for a deviated well, according to some implementations.

FIG. 2 illustrates a schematic 200 of stress transformation for a deviated and horizontal well, according to some implementations. As shown in FIG. 2, $S_h$ and $S_H$ are the minimum and maximum horizontal stresses ($|S_H|>|S_h|$), $S_v$ is the vertical (overburden) stress, $\alpha_b$ is the inclination angle of the well (from the vertical axis), β is the azimuth angle of the well relative to the $S_H$ direction, and θ is the wellbore circumferential angle.

In some implementations, the stress distribution (in polar coordinates) at the wellbore wall is given by Equation set (14):

$$\begin{cases} \sigma_r = p_w - \delta\phi(p_w - p_p) \\ \sigma_\theta = \sigma_{xx} + \sigma_{yy} - 2(\sigma_{xx} - \sigma_{yy})\cos(2\theta) - 4\,\sigma_{xy}\sin(2\theta) + K_1(p_w - p_p) - p_w \\ \sigma_z = \sigma_{zz} - 2\nu[(\sigma_{xx} - \sigma_{yy})\cos(2\theta) + 2\,\sigma_{xy}\sin(2\theta)] + K_1(p_w - p_p) \\ \sigma_{\theta z} = 2(\sigma_{yz}\cos(\theta) - \sigma_{xz}\sin(\theta)) \\ \sigma_{r\theta} = \sigma_{rz} = 0 \end{cases}, \tag{14}$$

where $$K_1 = \delta\left[\frac{\alpha(1-2\nu)}{1-\nu} - \phi\right], \tag{15}$$

and $$\begin{cases} \sigma_{xx} = S_H\cos^2(\alpha_b)\cos^2(\beta) + S_h\cos^2(\alpha_b)\sin^2(\beta) + S_v\sin^2(\alpha_b) \\ \sigma_{yy} = S_H\sin^2(\beta) + S_h\cos^2(\beta) \\ \sigma_{zz} = S_H\sin^2(\alpha_b)\cos^2(\beta) + S_h\sin^2(\alpha_b)\sin^2(\beta) + S_v\cos^2(\alpha_b) \\ \sigma_{xy} = -S_H\cos(\alpha_b)\cos(\beta)\sin(\beta) + S_h\cos(\alpha_b)\cos(\beta)\sin(\beta) \\ \sigma_{yz} = -S_H\sin(\alpha_b)\cos(\beta)\sin(\beta) + S_h\sin(\alpha_b)\cos(\beta)\sin(\beta) \\ \sigma_{xz} = S_H\cos(\alpha_b)\sin(\alpha_b)\cos^2(\beta) + S_h\cos(\alpha_b)\sin(\alpha_b)\sin^2(\beta) - S_v\cos(\alpha_b)\sin(\alpha_b) \end{cases}. \tag{16}$$

In Equation Sets (14) and (16), $\sigma_{xx}$, $\sigma_{yy}$, $\sigma_{zz}$, $\sigma_{xy}$, $\sigma_{yz}$, and $\sigma_{xz}$ are the in-situ stress components of the transformed Cartesian local coordinate system. Further, $\sigma_r$, $\sigma_\theta$, $\sigma_z$, $\sigma_{\theta z}$, $\sigma_{r\theta}$, and $\sigma_{r\theta}$ represent the stress distribution at the wellbore wall in polar coordinates (r, θ, z) obtained by linear superposition. In particular, $\sigma_r$, $\sigma_\theta$, and $\sigma_z$ are the radial, hoop, and axial stress components, and $\sigma_{\theta z}$, $\sigma_{r\theta}$, and $\sigma_{rz}$ are shear stress components respectively. Moreover, $p_w$ is the wellbore pressure (pressure inside the well), $p_p$ is the pore pressure (pressure outside the well), α is the Biot poroelastic coefficient, υ is the Poisson ratio, ϕ is the porosity, and δ is the wellbore permeability coefficient.

In some implementations, to compute the upper bound for the breakdown pressure, the wellbore permeability coefficient is set to 0 (δ=0) to obtain Equation Set (17):

$$\begin{cases} \sigma_r = p_w \\ \sigma_\theta = \sigma_{xx} + \sigma_{yy} - 2(\sigma_{xx} - \sigma_{yy})\cos(2\theta) - 4\,\sigma_{xy}\sin(2\theta) - p_w \\ \sigma_z = \sigma_{zz} - 2\nu[(\sigma_{xx} - \sigma_{yy})\cos(2\theta) + 2\,\sigma_{xy}\sin(2\theta)] \\ \sigma_{\theta z} = 2(\sigma_{yz}\cos(\theta) - \sigma_{xz}\sin(\theta)) \\ \sigma_{r\theta} = \sigma_{rz} = 0 \end{cases}. \tag{17}$$

To compute the upper bound in these generalized settings, the maximum principal stress component acting on the θz-plane is found and balanced with the tensile strength of the rock. To find the principal stresses on the θz-plane, a 2D plane stress problem in which $\sigma_r=\sigma_{r\theta}=\sigma_{rz}=0$ is solved. To do so, the 2D stress tensor on the θz-plane is written as:

$$\sigma = \begin{bmatrix} 0 & 0 & 0 \\ 0 & \sigma_\theta & \sigma_{\theta z} \\ 0 & \sigma_{z\theta} & \sigma_z \end{bmatrix}. \tag{18}$$

To compute the principal stress acting on the θz-plane, the eigenvalues of σ are found. To do so, the eigenvalues (λ) are calculated such that $$\det(\sigma - \lambda I) = 0. \tag{19}$$

By replacing the 2D stress tensor in Equation (19) with the Matrix (18), Equation (19) translates to:

$$\det\left(\begin{bmatrix} -\lambda & 0 & 0 \\ 0 & \sigma_\theta - \lambda & \sigma_{\theta z} \\ 0 & \sigma_{z\theta} & \sigma_z - \lambda \end{bmatrix}\right) = 0. \tag{20}$$

Then, Equation (21) results from expanding the determinant in Equation (20):

$$-\lambda\left((\sigma_\theta - \lambda)(\sigma_z - \lambda) - \sigma_{\theta z}^2\right) = 0. \tag{21}$$

Equation (21) can be solved such that either $\lambda=0$ (which corresponds to the principal stress acting on the r-direction, recall that $\sigma_r=\sigma_{r\theta}=\sigma_{rz}=0$), or $((\sigma_\theta-\lambda)(\sigma_z-\lambda)-\sigma_{\theta z}^2)=0$. Thus, Equation (21) can be written as a Quadratic Equation (22):

$$\lambda^2 - (\sigma_\theta + \sigma_z)\lambda + \sigma_\theta\sigma_z - \sigma_{\theta z}^2 = 0. \tag{22}$$

The unknown variable in Quadratic Equation (22) is $\lambda$, which admits the following general solution:

$$\lambda_{1,2} = \frac{(\sigma_\theta + \sigma_z) \pm \sqrt{(\sigma_\theta + \sigma_z)^2 - 4\left(\sigma_\theta\sigma_z - \sigma_{\theta z}^2\right)}}{2} = \frac{(\sigma_\theta + \sigma_z) \pm \sqrt{\sigma_\theta^2 + 2\sigma_\theta\sigma_z + \sigma_z^2 - 4\left(\sigma_\theta\sigma_z - \sigma_{\theta z}^2\right)}}{2} = \frac{(\sigma_\theta + \sigma_z) \pm \sqrt{(\sigma_\theta - \sigma_z)^2 + 4\sigma_{\theta z}^2}}{2} = \frac{(\sigma_\theta + \sigma_z)}{2} \pm \sqrt{\left(\frac{\sigma_\theta - \sigma_z}{2}\right)^2 + \sigma_{\theta z}^2}. \tag{23}$$

Equation (23) gives the two eigenvalues of the stress tensor $\sigma$. Now, the maximum eigenvalue is the maximum principal stress $\sigma_2$ acting on the $\theta$z-plane. The maximum principal stress $\sigma_2$ is represented in Equation (24) as $$\sigma_2 = \frac{(\sigma_\theta + \sigma_z)}{2} + \sqrt{\left(\frac{\sigma_\theta - \sigma_z}{2}\right)^2 + \sigma_{\theta z}^2}. \tag{24}$$

In some implementations, to calculate the upper bound of the breakdown pressure, $p_w$ is calculated such that $\sigma_2=-\sigma_f$, where $(\sigma_f)$ is the tensile strength of the rock. This translates Equation (24) into:

$$-\sigma_f = \frac{(\sigma_\theta + \sigma_z)}{2} + \sqrt{\left(\frac{\sigma_\theta - \sigma_z}{2}\right)^2 + \sigma_{\theta z}^2}$$

$$-\sigma_f = \frac{(\sigma_\theta' + \sigma_z)}{2} - \frac{p_w}{2} + \sqrt{\left(\frac{\sigma_\theta' - \sigma_z}{2} - \frac{p_w}{2}\right)^2 + \sigma_{\theta z}^2}. \tag{25}$$

where $$\sigma_\theta = \sigma_\theta' - p_w. \tag{26}$$

-continued $$\sigma_\theta' = \sigma_{xx} + \sigma_{yy} - 2(\sigma_{xx} - \sigma_{yy})\cos(2\theta) - 4\sigma_{xy}\sin(2\theta). \tag{27}$$

Equation (25) can be rewritten as:

$$-\sigma_f - \frac{(\sigma_\theta' + \sigma_z)}{2} + \frac{p_w}{2} = \sqrt{\left(\frac{\sigma_\theta' - \sigma_z}{2} - \frac{p_w}{2}\right)^2 + \sigma_{\theta z}^2}.$$

Both sides of the equation are then squared:

$$\left(-\sigma_f - \frac{(\sigma_\theta' + \sigma_z)}{2} + \frac{p_w}{2}\right)^2 = \left(\frac{\sigma_\theta' - \sigma_z}{2} - \frac{p_w}{2}\right)^2 + \sigma_{\theta z}^2.$$

Then, both sides of the equation are expanded:

$$\left(\sigma_f + \frac{(\sigma_\theta' + \sigma_z)}{2}\right)^2 - \left(\sigma_f + \frac{(\sigma_\theta' + \sigma_z)}{2}\right)p_w + \frac{p_w^2}{4} = \left(\frac{\sigma_\theta' - \sigma_z}{2}\right)^2 - \left(\frac{\sigma_\theta' - \sigma_z}{2}\right)p_w + \frac{p_w^2}{4} + \sigma_{\theta z}^2.$$

Solving the above equations leads to Equation (28):

$$p_w\left(-\sigma_f - \frac{(\sigma_\theta' + \sigma_z)}{2} + \frac{\sigma_\theta' - \sigma_z}{2}\right) = \left(\frac{\sigma_\theta' - \sigma_z}{2}\right)^2 + \sigma_{\theta z}^2 - \left(\sigma_f + \frac{(\sigma_\theta' + \sigma_z)}{2}\right)^2. \tag{28}$$

Equation (28) can be simplified to:

$$p_w = \frac{1}{(-\sigma_f - \sigma_z)}\left(\left(\frac{\sigma_\theta' - \sigma_z}{2}\right)^2 + \sigma_{\theta z}^2 - \left(\sigma_f + \frac{(\sigma_\theta' + \sigma_z)}{2}\right)^2\right). \tag{29}$$

Using Equation (29), the upper bound for the breakdown pressure is then calculated as:

$$P_{f-UpperBound} = \min_{0\le\theta\le\pi}\left[\frac{1}{(-\sigma_f - \sigma_z)}\left(\left(\frac{\sigma_\theta' - \sigma_z}{2}\right)^2 + \sigma_{\theta z}^2 - \left(\sigma_f + \frac{(\sigma_\theta' + \sigma_z)}{2}\right)^2\right)\right]. \tag{30}$$

Figure 3:
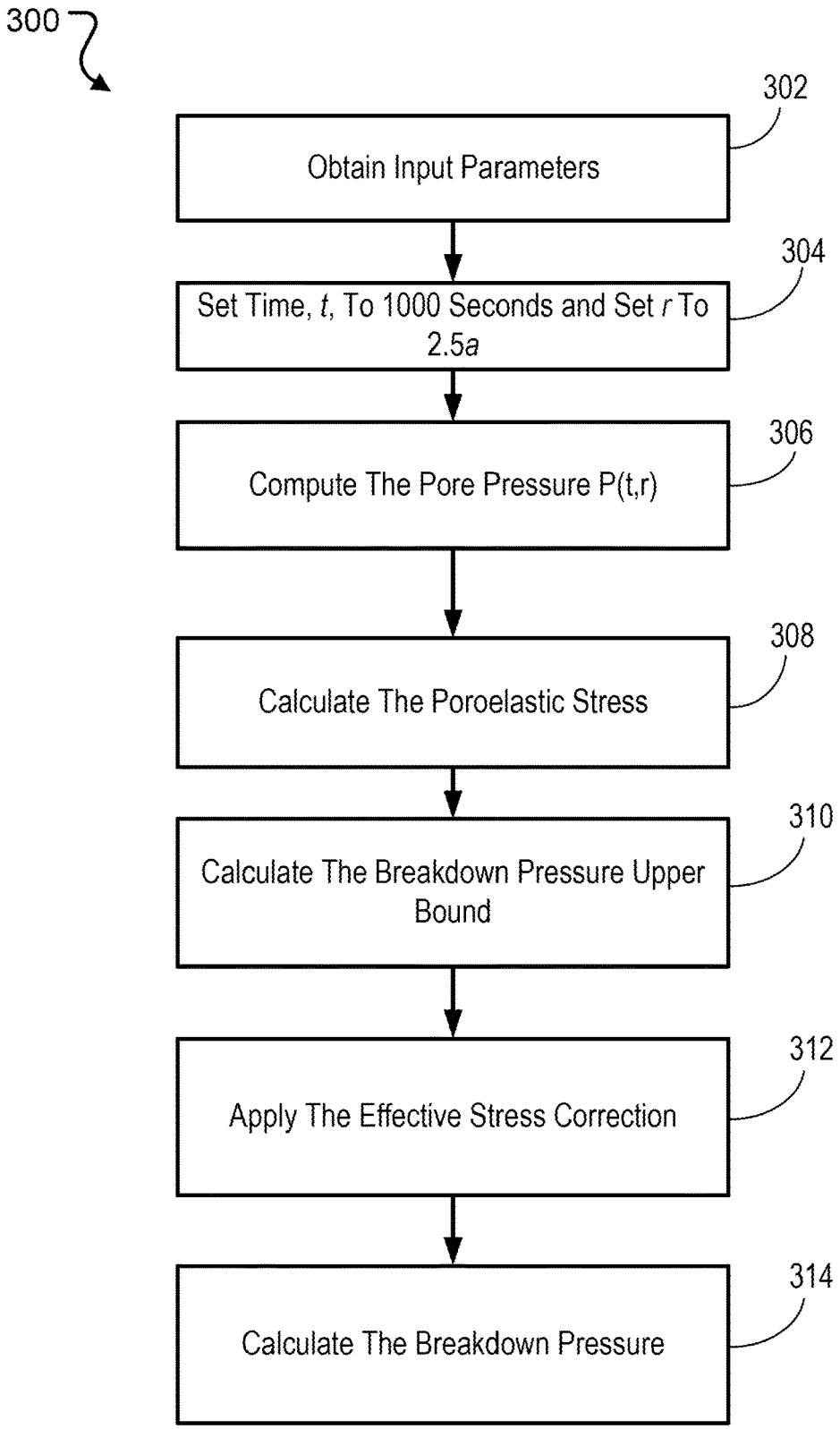
FIG. 3 illustrates an example breakdown pressure calculation workflow, according to some implementations.

FIG. 3 illustrates an example breakdown pressure calculation workflow 300, according to some implementations. The workflow 300 can be used to calculate the formation breakdown pressure near a wellbore. The wellbore can be a vertical wellbore, a horizontal and deviated wellbore, or any other type of wellbore of any orientation. The workflow 300 can be performed by a computer system having one or more computers located in one or more locations and programmed appropriately in accordance with this specification. An example of the computer system is the computing system 600 illustrated in FIG. 6 and described below.

At step 302, the computing system obtains input parameters for the workflow 300. Obtaining the input parameters can include receiving input parameter values from other devices or systems, determining predetermined values for input parameters, and/or setting values for input parameters. In some examples, the input parameters include, but are not limited to, initial wellbore pressure $P_0$, rock permeability K, rock porosity Ø, injection fluid compressibility $c_f$, injection fluid viscosity μ, minimum and maximum horizontal stresses $S_h$ and $S_H$, overburden vertical stress $S_v$, tensile strength of the formation rock $\sigma_f$, Biot poroelastic parameter α, Poisson Ratio ν, inclination angle of the well $\alpha_b$, azimuth angle of the well relative to the $S_H$ direction β, wellbore radius a, at a particular depth.

At step 304, the computer system sets the time, t, to 1000 seconds and sets r to 2.5a. The time "t" is the time at which the fracture will initiate (e.g., the formation will break) after pumping the drilling fluid at a very high pressure to hydraulically frack/break the formation. In one example, the time, t, is set to 1000 seconds (around 16.6 minutes) for the formation to frack after starting the hydraulic fracturing job.

At step 306, the computer system computes the pore pressure p(t,r) using Equations (9), (10), and (11). For the purposes of this workflow, Equations (9), (10), and (11) are reproduced below as Equations (31), (32), and (33), respectively.

$$p(t, r) = \frac{\ln(2)}{t}\sum_{i=1}^{n}\left(c_i\frac{P_0K_0\left(\sqrt{\frac{i\ln(2)}{tc}}\,r\right)}{\frac{i\ln(2)}{t}K_0\left(\sqrt{\frac{i\ln(2)}{tc}}\,a\right)}\right), \tag{31}$$

where $$c_i = (-1)^{i+\frac{n}{2}}\sum_{k=\left\lfloor\frac{i+1}{2}\right\rfloor}^{\min\left(i,\frac{n}{2}\right)}\left(\frac{k^{\frac{n}{2}}(2k)!}{\left(\frac{n}{2}-k\right)!k!(k-1)!(i-k)!(2k-i)!}\right), \tag{32}$$

$$c = \frac{K}{\mu\phi c_f}. \tag{33}$$

In some examples, the computer system sets n=8, but other values are possible.

At step 308, the computer system calculates the poroelastic stress using Equation (12), which is reproduced below as Equation (34):

$$S_\theta^{(3)}(t, r) = \alpha\left(\frac{1-2\nu}{1-\nu}\right)\left(\frac{1}{r^2}\int_{r_0}^{r} p(t, \rho)\rho\, d\rho - p(t, r)\right). \tag{34}$$

In some examples, the computer system evaluates the integral in Equation (34) using the Composite Simpson's Rule for numerical integration. The steps for evaluating the integral in Equation (34) using the Composite Simpson's Rule for numerical integration is depicted in Table (1) below.

TABLE 1

| Compute the Poroelastic Stress $S_\theta^{(3)}(t, r)$ | |
|---|---|
| | Compute the Poroelastic Stress $S_\theta^{(3)}(t, r)$ as given in Equation (34) |
| | $S_\theta^{(3)}(t, r) = \alpha\left(\frac{1-2\nu}{1-\nu}\right)\left(\frac{1}{r^2}\int_{r_0}^{r} p(t, \rho)\rho\, d\rho - p(t, r)\right)$ |
| | Using the Composite Simpson's Rule for numerical integration as follows: |
| Step 1.1 | Set $h = \frac{r-r_0}{N}$ ($N$ is the number of sub−intervals used in the numerical |
| | Composite Simpson's Rule, for example, N = 1000) |
| Step 1.2 | Set xa = p(t, $r_0$) × $r_0$ |
| | Set xb = p(t, r) × r |
| Step 1.3 | Set EvenTerms = 0.0 |
| Step 1.4 | Set OddTerms = 0.0 |
| Step 1.5 | For(i = 1 to N − 1){ |
| | Set x = $r_0$ + ih |
| | If (Modulus(i, 2) = 0) |
| | EvenTerms = EvenTerms + p(t, x) × x |
| | Else |
| | OddTerms = OddTerms + p(t, x) × x |
| | } |
| | Set Integral = $\frac{h}{3}(xa + xb + 2\times EvenTerms + 4\times OddTerms)$ |
| Step 1.6 | $S_\theta^{(3)}(t, r) = \alpha\left(\frac{1-2\nu}{1-\nu}\right)\left(\frac{1}{r^2}\text{ Integral} - p(t, r)\right)$ |

At step 310, the computer system calculates the breakdown pressure upper bound using Equation (30), which is reproduced below as Equation (35):

$$P_{f-UpperBound} = \underset{0\le\theta\le\pi}{\text{Min}}\left[\frac{1}{(-\sigma_f-\sigma_z)}\left(\left(\frac{\sigma_\theta'-\sigma_z}{2}\right)^2 + \sigma_{\theta z}^2 - \left(\sigma_f + \frac{(\sigma_\theta'+\sigma_z)}{2}\right)^2\right)\right]. \tag{35}$$

At step 312, the computer system applies an effective stress correction to the breakdown pressure upper bound. In some examples, the effective stress correction is based on whether the wellbore is an open hole wellbore or a cemented liner wellbore. More specifically, if the wellbore is open hole, the computer system applies the correction of Equation (36):

$$P_{f-UpperBound} = P_{f-UpperBound} - \left(2 - \alpha\left(\frac{1-2\nu}{1-\nu}\right)\right)P_0. \tag{36}$$

And if the wellbore is a cemented liner wellbore, the computer system applies the correction of Equation (37):

$$P_{f-UpperBound} = P_{f-UpperBound} - \alpha P_0. \quad (37)$$

At step 314, the computer system calculates the breakdown pressure $P_f$ using Equation (38):

$$P_f = P_{f-UpperBound} - S_\theta^{(3)}(t, r) - p(t, r). \quad (38)$$

Figure 4A:
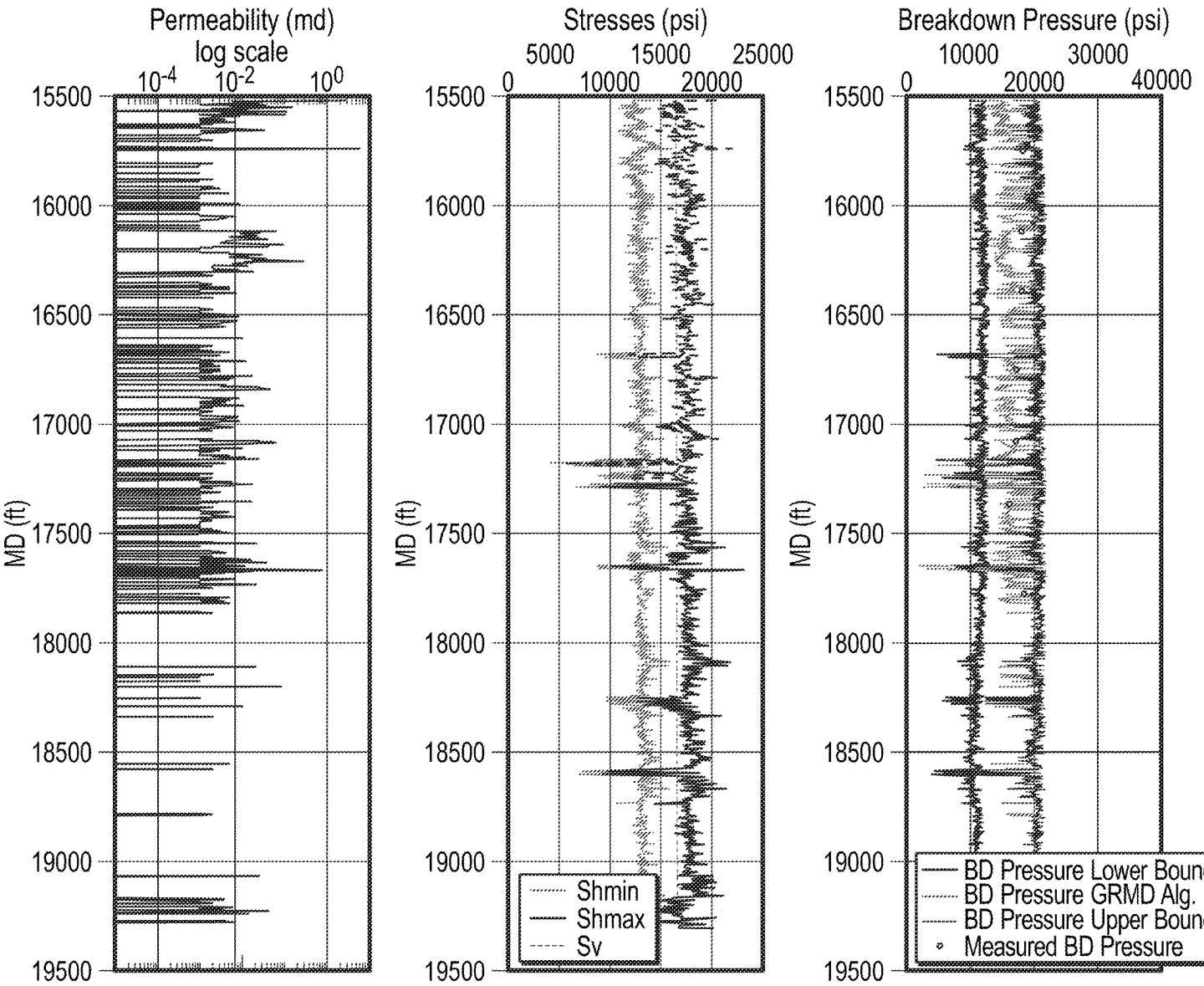
FIG. 4A illustrates the results of measured breakdown pressure and the computed breakdown pressure in deviated wellbores with an open hole, according to some implementations.
Figure 4B:
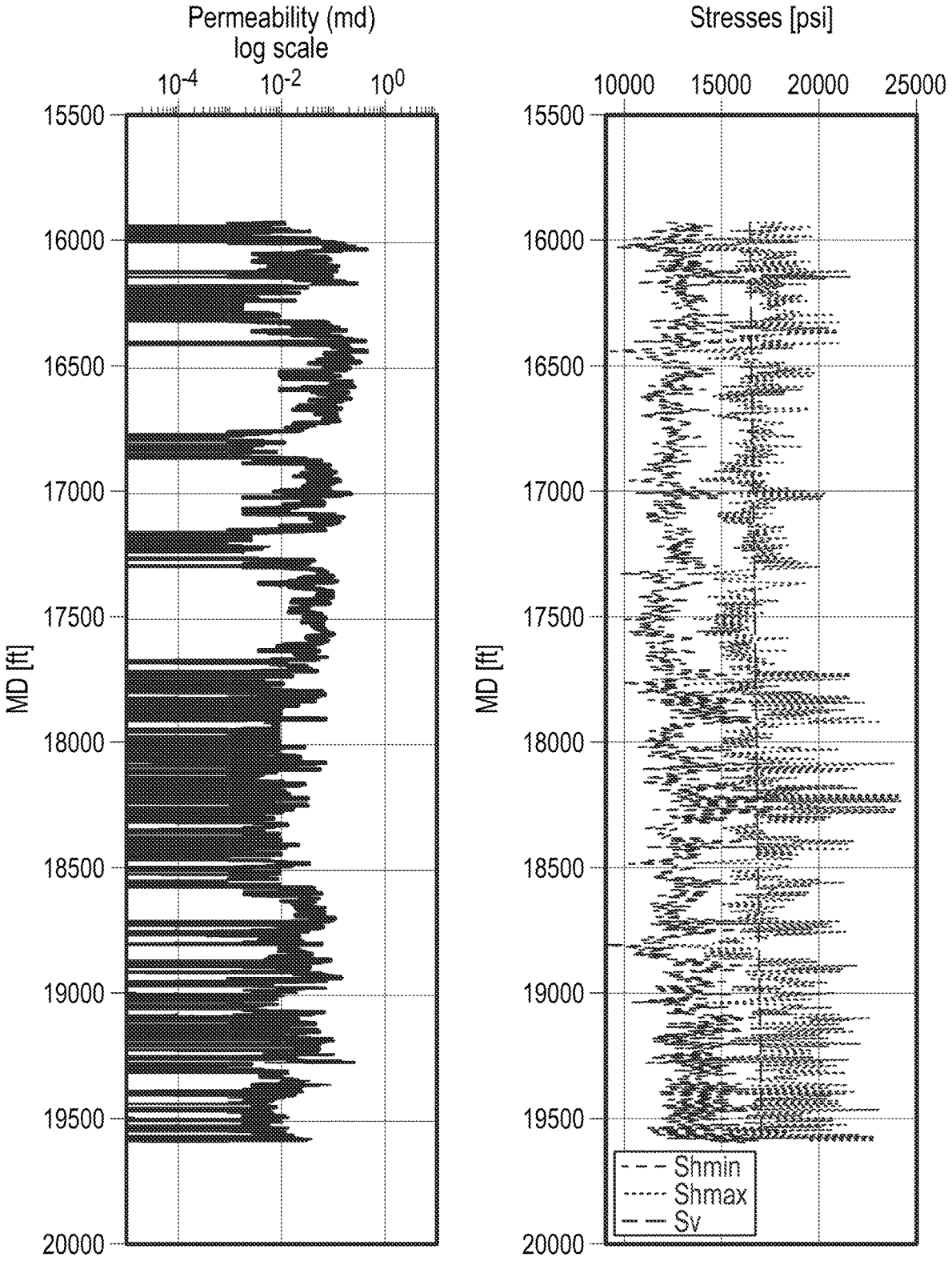
FIG. 4B illustrates the results of measured breakdown pressure and the computed breakdown pressure in deviated wellbores with cement liner completions, according to some implementations.
Figure 4B:
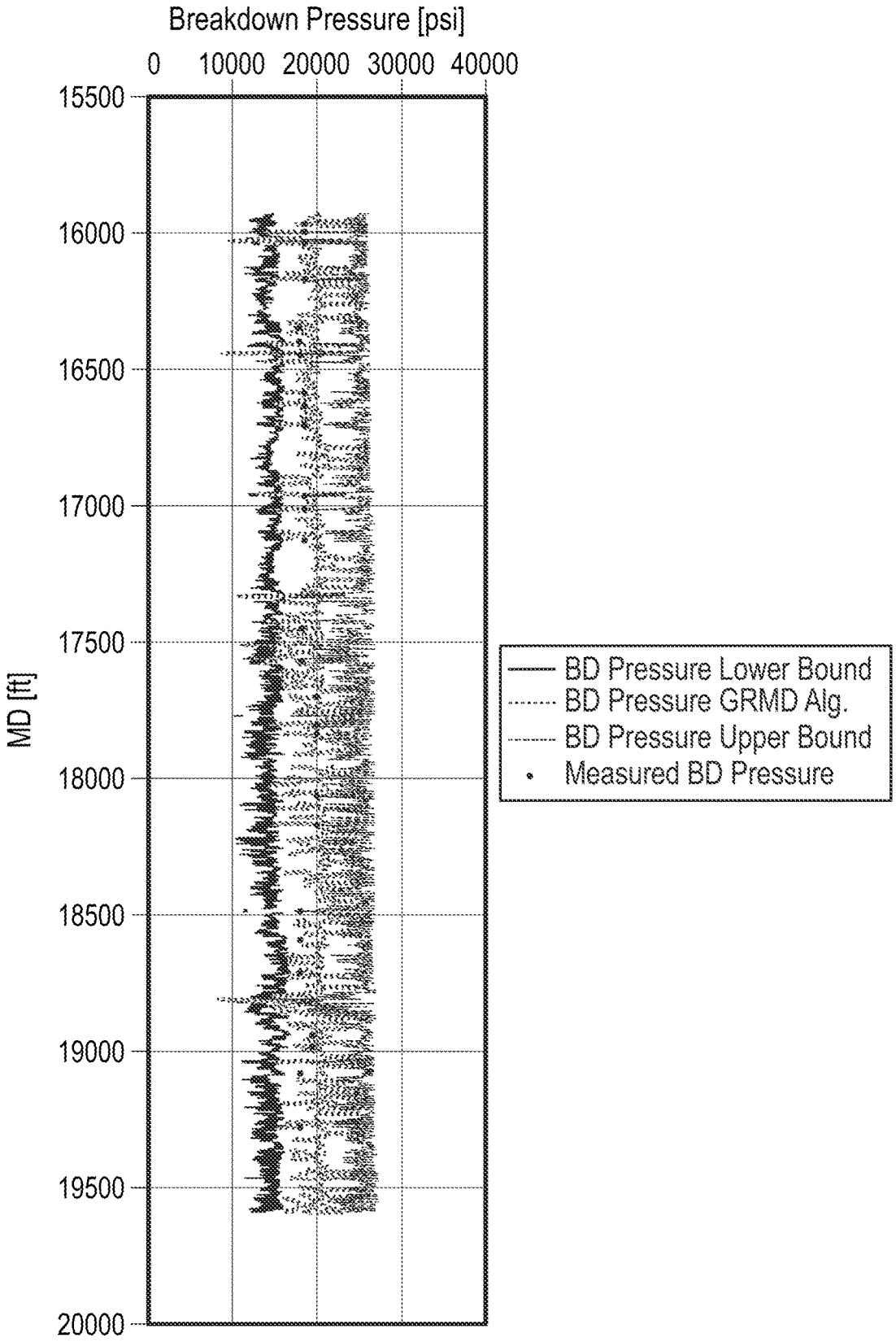

FIGS. 4A and 4B illustrate the results of measured breakdown pressure and the computed breakdown pressure in deviated wells with open hole and cement liner completions, respectively. The workflow 300 of FIG. 3 was implemented and tested in Matlab against two deviated wells (one well is with an open hole completion, and the other a cemented liner). The results for the open hole well are shown in FIG. 4A, along with the upper and lower bounds. The results for the cemented liner are shown in FIG. 4B. FIGS. 4A and 4B show a very close match between the measured (actual) breakdown pressure, and the computed breakdown pressure (by workflow 300) in both cases.

More specifically, FIG. 4A illustrates the results of measured (actual) breakdown pressure, and the computed breakdown pressure (by workflow 300) in an open hole deviated well. The plot on the left shows the formation permeability values (in log scale), and the plot on the right shows the corresponding breakdown pressure values computed in three different ways: the blue curve uses the lower bound formula (Equation (8)), the yellow curve uses the upper bound formula (Equation (7)), and the orange curve uses workflow 300. The actual (measured) breakdown pressure values are shown in black dots and match the orange curve (workflow 300) very closely.

FIG. 4B illustrates the results of measured (actual) breakdown pressure, and the computed breakdown pressure (by workflow 300) in a cemented liner deviated well. The plot on the left shows the formation permeability values (in log scale), and the plot on the right shows the corresponding breakdown pressure values computed in three different ways: the blue curve uses the lower bound formula (Equation (8)), and the yellow curve uses the upper bound formula (Equation (7)), and the orange curve uses workflow 300. The actual (measured) breakdown pressure values are shown in black dots and match the orange curve (workflow 300) very closely.

Figure 5:
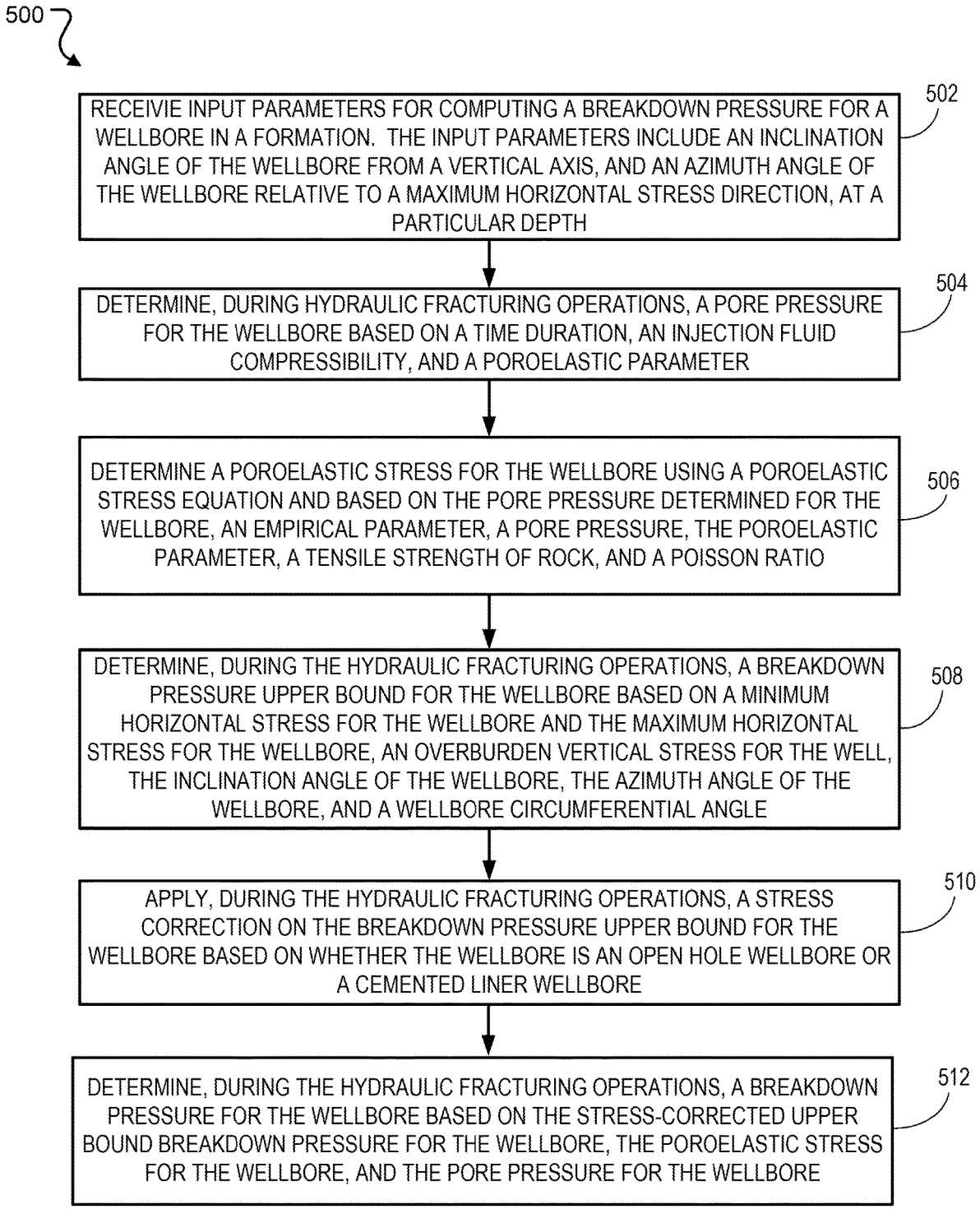
FIG. 5 illustrates a flowchart of an example method, according to some implementations.

FIG. 5 illustrates a flowchart of an example method 500, according to some implementations. For clarity of presentation, the description that follows generally describes method 500 in the context of the other figures in this description. For example, method 500 can be performed by computer system 600 of FIG. 6. It will be understood that method 500 can be performed, for example, by any suitable system, environment, software, hardware, or a combination of systems, environments, software, and hardware, as appropriate. In some implementations, various steps of method 500 can be run in parallel, in combination, in loops, or in any order.

At step 502, method 500 involves receiving input parameters for computing a breakdown pressure for a wellbore in a formation. The input parameters include an inclination angle of the wellbore from a vertical axis, and an azimuth angle of the wellbore relative to a maximum horizontal stress direction, at a particular depth.

At step 504, method 500 involves determining, during hydraulic fracturing operations, a pore pressure for the wellbore based on a time duration, an injection fluid compressibility, and a poroelastic parameter.

At step 506, method 500 involves determining a poroelastic stress for the wellbore using a poroelastic stress equation and based on the pore pressure determined for the wellbore, an empirical parameter, a pore pressure, the poroelastic parameter, a tensile strength of rock, and a Poisson ratio.

At step 508, method 500 involves determining, during the hydraulic fracturing operations, a breakdown pressure upper bound for the wellbore based on a minimum horizontal stress for the wellbore and the maximum horizontal stress for the wellbore, an overburden vertical stress for the well, the inclination angle of the wellbore, the azimuth angle of the wellbore, and a wellbore circumferential angle.

At step 510, method 500 involves applying, during the hydraulic fracturing operations, a stress correction on the breakdown pressure upper bound for the wellbore based on whether the wellbore is an open hole wellbore or a cemented liner wellbore.

At step 512, method 500 involves determining, during the hydraulic fracturing operations, a breakdown pressure for the wellbore based on the stress-corrected upper bound breakdown pressure for the wellbore, the poroelastic stress for the wellbore, and the pore pressure for the wellbore.

In some implementations, the method further involves determining, based at least on the breakdown pressure, a horsepower level needed for creating a fracture geometry used in the hydraulic fracturing operations; determining a successful placement of stimulation materials for the hydraulic fracturing operations; determining, based at least on the breakdown pressure, a pressure rating of tubulars required for fracturing treatment; and completing the hydraulic fracturing operations using the horsepower level, the successful placement of the stimulation materials, and one or more tubulars having the determined pressure rating of the tubulars required for the fracturing treatment.

A prior estimation/prediction of the formation breakdown pressure is needed to determine the technical and operational specifications of the multistage well completion system required on site. These operational specifications include the pressure rating (e.g., is a 10,000 psi-rated multistage completion system or a 15,000 psi-rated multistage completion system to be used). Higher pressure ratings of the well completion will require higher horsepower levels, and vice versa. More specifically, if the predicted breakdown pressure is higher than 15,000 psi, then a 10,000 psi-rated well completion system is inadequate to successfully frack the formation. On the other hand, if the predicted breakdown pressure is less than 15,000 psi, then a 15,000 psi-rated well completion system might not be needed which will save unnecessary costs due to over-design of completion and surface equipment.

During the hydraulic fracturing process, a fluid is pumped into the well at a very high pressure (in some cases it can reach up to 15,000 psi). Water-based fluids (slick-water) are the most commonly used fluids during this well stimulation activity (i.e., hydraulic fracturing). If the predicted breakdown pressure is high, then other chemical additives (such as special chemical-based viscoelastic surfactants) can be added/combined with the fracturing fluid to increase its density and improve its efficiency, and therefore, reduce the horsepower level of the surface equipment to meet the formation breakdown pressure requirements. Therefore, knowing the breakdown pressure in advance (in addition to the completion type) can also help selecting the type of stimulation materials that should be added to the fracturing fluid.

In some implementations, determining the pore pressure for the wellbore involves determining the pore pressure for the wellbore using a Stehfest method equation that is a function of the time duration, a distance from the wellbore in a radial direction, the injection fluid compressibility, and the poroelastic parameter.

In some implementations, the Stehfest method equation is further a function of a modified Bessel function of a second kind of order 0.

In some implementations, the poroelastic stress is further based on a Composite Simpson's Rule for numerical integration.

In some implementations, the input parameters further include an initial wellbore pressure, a rock permeability, a rock porosity, an injection fluid compressibility, an injection fluid viscosity, a Poisson ratio of the formation rock, a wellbore radius, and a distance from the wellbore in a radial direction, at a particular depth.

In some implementations, an initial value for the distance from the wellbore in a radial direction is two and a half the wellbore radius.

In some implementations, the wellbore is one of: (i) a deviated and horizontal wellbore, or (ii) a vertical wellbore.

In some implementations, an initial value for the time duration is a time at which the formation is expected to break after a slurry injection.

In some implementations, an initial value for the time duration is 1000 seconds.

In some implementations, the wellbore includes either open hole completions or cement liners.

Figure 6:
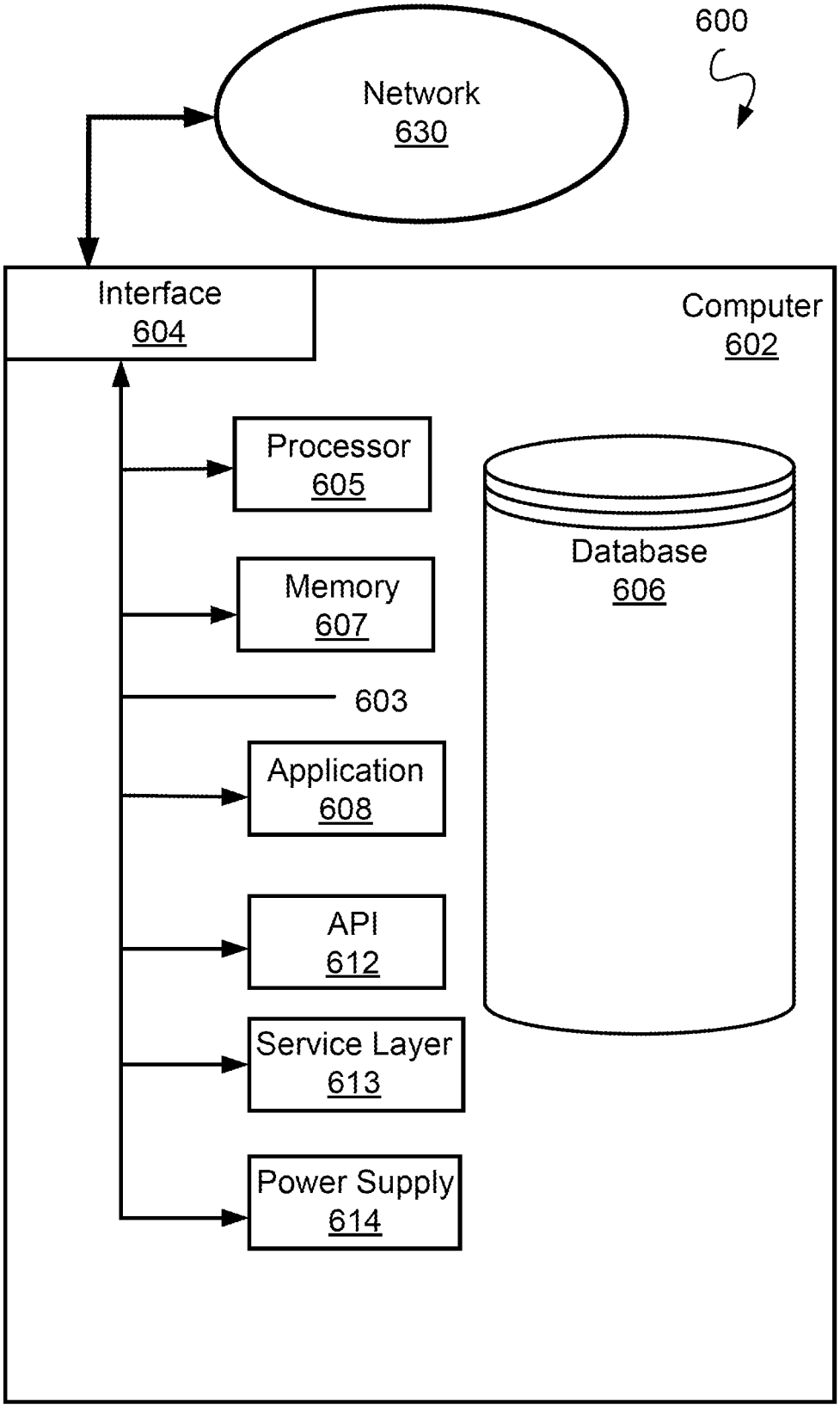
FIG. 6 is a block diagram of an example computer system that can be used to provide computational functionalities associated with described algorithms, methods, functions, processes, flows, and procedures, according to some implementations.

FIG. 6 is a block diagram of an example computer system 600 that can be used to provide computational functionalities associated with described algorithms, methods, functions, processes, flows, and procedures, according to some implementations of the present disclosure.

The illustrated computer 602 is intended to encompass any computing device such as a server, a desktop computer, an embedded computer, a laptop/notebook computer, a wireless data port, a smart phone, a personal data assistant (PDA), a tablet computing device, or one or more processors within these devices, including physical instances, virtual instances, or both. The computer 602 can include input devices such as keypads, keyboards, and touch screens that can accept user information. Also, the computer 602 can include output devices that can convey information associated with the operation of the computer 602. The information can include digital data, visual data, audio information, or a combination of information.

The information can be presented in a graphical user interface (UI) (or GUI). In some implementations, the inputs and outputs include display ports (such as DVI-I+2× display ports), USB 3.0, GbE ports, isolated DI/O, SATA-III (6.0 Gb/s) ports, mPCIe slots, a combination of these, or other ports. In instances of an edge gateway, the computer 602 can include a Smart Embedded Management Agent (SEMA), such as a built-in ADLINK SEMA 2.2, and a video sync technology, such as Quick Sync Video technology supported by ADLINK MSDK+. In some examples, the computer 602 can include the MXE-5400 Series processor-based fanless embedded computer by ADLINK, though the computer 602 can take other forms or include other components.

The computer 602 can serve in a role as a client, a network component, a server, a database, a persistency, or components of a computer system for performing the subject matter described in the present disclosure. The illustrated computer 602 is communicably coupled with a network 630. In some implementations, one or more components of the computer 602 can be configured to operate within different environments, including cloud-computing-based environments, local environments, global environments, and combinations of environments.

At a high level, the computer 602 is an electronic computing device operable to receive, transmit, process, store, and manage data and information associated with the described subject matter. According to some implementations, the computer 602 can also include, or be communicably coupled with, an application server, an email server, a web server, a caching server, a streaming data server, or a combination of servers.

The computer 602 can receive requests over network 630 from a client application (for example, executing on another computer 602). The computer 602 can respond to the received requests by processing the received requests using software applications. Requests can also be sent to the computer 602 from internal users (for example, from a command console), external (or third) parties, automated applications, entities, individuals, systems, and computers.

Each of the components of the computer 602 can communicate using a system bus 603. In some implementations, any or all of the components of the computer 602, including hardware or software components, can interface with each other or the interface 604 (or a combination of both), over the system bus. Interfaces can use an application programming interface (API) 612, a service layer 613, or a combination of the API 612 and service layer 613. The API 612 can include specifications for routines, data structures, and object classes. The API 612 can be either computer-language independent or dependent. The API 612 can refer to a complete interface, a single function, or a set of APIs 612.

The service layer 613 can provide software services to the computer 602 and other components (whether illustrated or not) that are communicably coupled to the computer 602. The functionality of the computer 602 can be accessible for all service consumers using this service layer 613. Software services, such as those provided by the service layer 613, can provide reusable, defined functionalities through a defined interface. For example, the interface can be software written in JAVA, C++, or a language providing data in extensible markup language (XML) format. While illustrated as an integrated component of the computer 602, in alternative implementations, the API 612 or the service layer 613 can be stand-alone components in relation to other components of the computer 602 and other components communicably coupled to the computer 602. Moreover, any or all parts of the API 612 or the service layer 613 can be implemented as child or sub-modules of another software module, enterprise application, or hardware module without departing from the scope of the present disclosure.

The computer 602 can include an interface 604. Although illustrated as a single interface 604 in FIG. 6, two or more interfaces 604 can be used according to particular needs, desires, or particular implementations of the computer 602 and the described functionality. The interface 604 can be used by the computer 602 for communicating with other systems that are connected to the network 630 (whether illustrated or not) in a distributed environment. Generally, the interface 604 can include, or be implemented using, logic encoded in software or hardware (or a combination of software and hardware) operable to communicate with the network 630. More specifically, the interface 604 can include software supporting one or more communication protocols associated with communications. As such, the network 630 or the interface's hardware can be operable to communicate physical signals within and outside of the illustrated computer 602.

The computer 602 includes a processor 605. Although illustrated as a single processor 605 in FIG. 6, two or more processors 605 can be used according to particular needs, desires, or particular implementations of the computer 602 and the described functionality. Generally, the processor 605 can execute instructions and manipulate data to perform the operations of the computer 602, including operations using algorithms, methods, functions, processes, flows, and procedures as described in the present disclosure.

The computer 602 can also include a database 606 that can hold data for the computer 602 and other components connected to the network 630 (whether illustrated or not). For example, database 606 can be an in-memory, conventional, or a database storing data consistent with the present disclosure. In some implementations, the database 606 can be a combination of two or more different database types (for example, hybrid in-memory and conventional databases) according to particular needs, desires, or particular implementations of the computer 602 and the described functionality. Although illustrated as a single database 606 in FIG. 6, two or more databases (of the same, different, or combination of types) can be used according to particular needs, desires, or particular implementations of the computer 602 and the described functionality. While database 606 is illustrated as an internal component of the computer 602, in alternative implementations, database 606 can be external to the computer 602.

The computer 602 also includes a memory 607 that can hold data for the computer 602 or a combination of components connected to the network 630 (whether illustrated or not). Memory 607 can store any data consistent with the present disclosure. In some implementations, memory 607 can be a combination of two or more different types of memory (for example, a combination of semiconductor and magnetic storage) according to particular needs, desires, or particular implementations of the computer 602 and the described functionality. Although illustrated as a single memory 607 in FIG. 6, two or more memories 607 (of the same, different, or combination of types) can be used according to particular needs, desires, or particular implementations of the computer 602 and the described functionality. While memory 607 is illustrated as an internal component of the computer 602, in alternative implementations, memory 607 can be external to the computer 602.

An application 608 can be an algorithmic software engine providing functionality according to particular needs, desires, or particular implementations of the computer 602 and the described functionality. For example, an application 608 can serve as one or more components, modules, or applications 608. Multiple applications 608 can be implemented on the computer 602. Each application 608 can be internal or external to the computer 602.

The computer 602 can also include a power supply 614. The power supply 614 can include a rechargeable or non-rechargeable battery that can be configured to be either user- or non-user-replaceable. In some implementations, the power supply 614 can include power-conversion and management circuits, including recharging, standby, and power management functionalities. In some implementations, the power-supply 614 can include a power plug to allow the computer 602 to be plugged into a wall socket or a power source to, for example, power the computer 602 or recharge a rechargeable battery.

There can be any number of computers 602 associated with, or external to, a computer system including computer 602, with each computer 602 communicating over network 630. Further, the terms "client," "user," and other appropriate terminology can be used interchangeably without departing from the scope of the present disclosure. Moreover, the present disclosure contemplates that many users can use one computer 602 and one user can use multiple computers 602.

Implementations of the subject matter and the functional operations described in this specification can be implemented in digital electronic circuitry, in tangibly embodied computer software or firmware; in computer hardware, including the structures disclosed in this specification and their structural equivalents; or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus and special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example, Linux, Unix, Windows, Mac OS, Android, or iOS.

A computer program, which can also be referred to or described as a program, software, a software application, a module, a software module, a script, or code can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document; in a single file dedicated to the program in question; or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes; the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks, optical memory devices, and technologies including, for example, digital video disc (DVD), CD ROM, DVD+/−R, DVD-RAM, DVD-ROM, HD-DVD, and BLURAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), or a plasma monitor. Display devices can include a keyboard and pointing devices including, for example, a mouse, a trackball, or a trackpad. User input can also be provided to the computer using a touchscreen, such as a tablet computer surface with pressure sensitivity or a multi-touch screen using capacitive or electric sensing. Other kinds of devices can be used to provide for interaction with a user, including to receive user feedback, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

Figure 7:
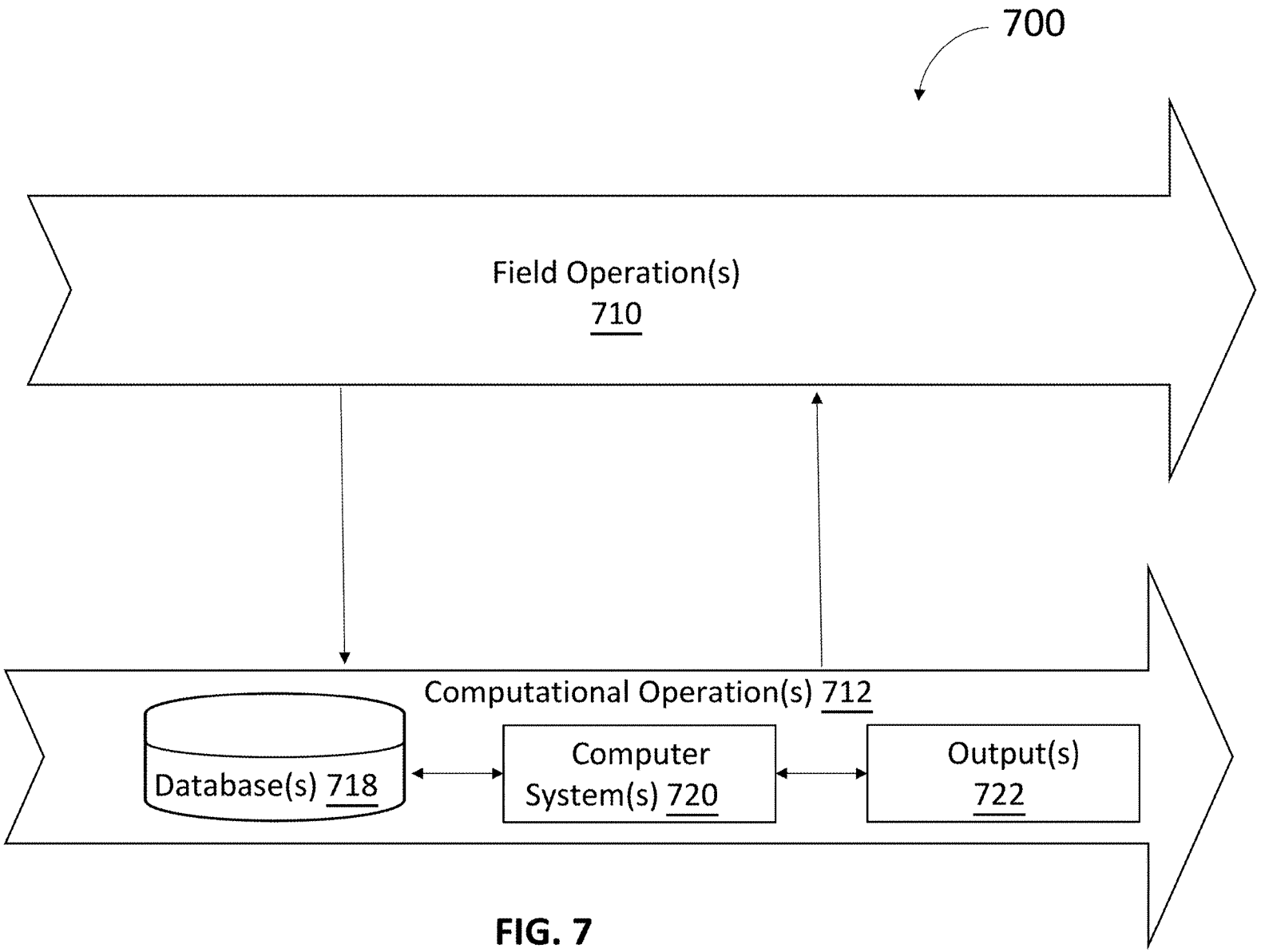
FIG. 7 illustrates hydrocarbon production operations, according to some implementations.

FIG. 7 illustrates hydrocarbon production operations 700 that include both one or more field operations 710 and one or more computational operations 712, which exchange information and control exploration for the production of hydrocarbons. In some implementations, outputs of techniques of the present disclosure can be performed before, during, or in combination with the hydrocarbon production operations 700, specifically, for example, either as field operations 710 or computational operations 712, or both.

Examples of field operations 710 include forming/drilling a wellbore, hydraulic fracturing, producing through the wellbore, injecting fluids (such as water) through the wellbore, to name a few. In some implementations, methods of the present disclosure can trigger or control the field operations 710. For example, the methods of the present disclosure can generate data from hardware/software including sensors and physical data gathering equipment (e.g., seismic sensors, well logging tools, flow meters, and temperature and pressure sensors). The methods of the present disclosure can include transmitting the data from the hardware/software to the field operations 710 and responsively triggering the field operations 710 including, for example, generating plans and signals that provide feedback to and control physical components of the field operations 710. Alternatively or in addition, the field operations 710 can trigger the methods of the present disclosure. For example, implementing physical components (including, for example, hardware, such as sensors) deployed in the field operations 710 can generate plans and signals that can be provided as input or feedback (or both) to the methods of the present disclosure.

Examples of computational operations 712 include one or more computer systems 720 that include one or more processors and computer-readable media (e.g., non-transitory computer-readable media) operatively coupled to the one or more processors to execute computer operations to perform the methods of the present disclosure. The computational operations 712 can be implemented using one or more databases 718, which store data received from the field operations 710 and/or generated internally within the computational operations 712 (e.g., by implementing the methods of the present disclosure) or both. For example, the one or more computer systems 720 process inputs from the field operations 710 to assess conditions in the physical world, the outputs of which are stored in the databases 718. For example, seismic sensors of the field operations 710 can be used to perform a seismic survey to map subterranean features, such as facies and faults. In performing a seismic survey, seismic sources (e.g., seismic vibrators or explosions) generate seismic waves that propagate in the earth and seismic receivers (e.g., geophones) measure reflections generated as the seismic waves interact with boundaries between layers of a subsurface formation. The source and received signals are provided to the computational operations 712 where they are stored in the databases 718 and analyzed by the one or more computer systems 720.

In some implementations, one or more outputs 722 generated by the one or more computer systems 720 can be provided as feedback/input to the field operations 710 (either as direct input or stored in the databases 718). The field operations 710 can use the feedback/input to control physical components used to perform the field operations 710 in the real world.

For example, the computational operations 712 can process the seismic data to generate three-dimensional (3D) maps of the subsurface formation. The computational operations 712 can use these 3D maps to provide plans for locating and drilling exploratory wells. In some operations, the exploratory wells are drilled using logging-while-drilling (LWD) techniques which incorporate logging tools into the drill string. LWD techniques can enable the computational operations 712 to process new information about the formation and control the drilling to adjust to the observed conditions in real-time.

The one or more computer systems 720 can update the 3D maps of the subsurface formation as information from one exploration well is received and the computational operations 712 can adjust the location of the next exploration well based on the updated 3D maps. Similarly, the data received from production operations can be used by the computational operations 712 to control components of the production operations. For example, production well and pipeline data can be analyzed to predict slugging in pipelines leading to a refinery and the computational operations 712 can control machine operated valves upstream of the refinery to reduce the likelihood of plant disruptions that run the risk of taking the plant offline.

In some implementations of the computational operations 712, customized user interfaces can present intermediate or final results of the above-described processes to a user. Information can be presented in one or more textual, tabular, or graphical formats, such as through a dashboard. The information can be presented at one or more on-site locations (such as at an oil well or other facility), on the Internet (such as on a webpage), on a mobile application (or app), or at a central processing facility.

The presented information can include feedback, such as changes in parameters or processing inputs, that the user can select to improve a production environment, such as in the exploration, production, and/or testing of petrochemical processes or facilities. For example, the feedback can include parameters that, when selected by the user, can cause a change to, or an improvement in, drilling parameters (including drill bit speed and direction) or overall production of a gas or oil well. The feedback, when implemented by the user, can improve the speed and accuracy of calculations, streamline processes, improve models, and solve problems related to efficiency, performance, safety, reliability, costs, downtime, and the need for human interaction.

In some implementations, the feedback can be implemented in real-time, such as to provide an immediate or near-immediate change in operations or in a model. The term real-time (or similar terms as understood by one of ordinary skill in the art) means that an action and a response are temporally proximate such that an individual perceives the action and the response occurring substantially simultaneously. For example, the time difference for a response to display (or for an initiation of a display) of data following the individual's action to access the data can be less than 1 millisecond (ms), less than 1 second(s), or less than 5 s. While the requested data need not be displayed (or initiated for display) instantaneously, it is displayed (or initiated for display) without any intentional delay, taking into account processing limitations of a described computing system and time required to, for example, gather, accurately measure, analyze, process, store, or transmit the data.

Events can include readings or measurements captured by downhole equipment such as sensors, pumps, bottom hole assemblies, or other equipment. The readings or measurements can be analyzed at the surface, such as by using applications that can include modeling applications and machine learning. The analysis can be used to generate changes to settings of downhole equipment, such as drilling equipment. In some implementations, values of parameters or other variables that are determined can be used automatically (such as through using rules) to implement changes in oil or gas well exploration, production/drilling, or testing. For example, outputs of the present disclosure can be used as inputs to other equipment and/or systems at a facility. This can be especially useful for systems or various pieces of equipment that are located several meters or several miles apart, or are located in different countries or other jurisdictions.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, or in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations; and the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

The nomenclature used in this disclosure is listed in Table 2:

TABLE 2

| Nomenclature |
|---|
| $P_f$ = Formation Breakdown Pressure (psi) |
| $\sigma_f$ = The Tensile Strengh of the Rock (psi) |
| $S_\theta^{(1)}$ = The Circumferential Stress (Stress due to Tetonic Stresses) (psi) |
| $S_\theta^{(2)}$ = Stress Induced by Borehole Pressure (psi) |
| $S_\theta^{(3)}$ = Poroelastic Stress (psi) |
| $P_p$ = Pore Pressure (psi) |
| $P_w$ = Borehole Pressure (psi) |
| $P_0$ = Initial Wellbore Pressure (psi) |
| $S_h$ = Minimum Horizontal Stress (psi) |
| $S_H$ = Maximum Horizontal Stress (psi) |
| r = Distance from Wellbore in Radial Direction (ft) |
| a = Wellbore Radius (ft) |
| p(t, r) = Pore Pressure (psi) as a Function of time (seconds), and Distance from Wellbore (ft) |
| K = Rock Permeability (md) |
| Ø = Rock Porosity (Dimensionless) |
| $c_f$ = Injection Fluid Compressiblity$\left(\frac{1}{psi}\right)$ |
| μ = Injection Fluid Viscosity (cp) |
| t = Time (seconds) |
| $K_0$ (x) = Modifed Bessel Function of the Second Kind of Order 0 |
| β = Empirical Parameter (Dimensionless) |
| α = Biot Poroelastic Paramter (Dimensionless) |
| v = Poisson Ratio (Dimensionless). |

What is claimed is:

1. A computer-implemented method, comprising:

receiving input parameters for computing a breakdown pressure for a wellbore in a formation, the input parameters comprising an inclination angle of the wellbore from a vertical axis, and an azimuth angle of the wellbore relative to a maximum horizontal stress direction, at a particular depth;

determining, during hydraulic fracturing operations, a pore pressure for the wellbore based on a time duration, an injection fluid compressibility, and a poroelastic parameter;

determining a poroelastic stress for the wellbore using a poroelastic stress equation and based on the pore pressure determined for the wellbore, an empirical parameter, a pore pressure, the poroelastic parameter, a tensile strength of rock, and a Poisson ratio;

determining, during the hydraulic fracturing operations, a breakdown pressure upper bound for the wellbore based on a minimum horizontal stress and a maximum horizontal stress for the wellbore, an overburden vertical stress for the wellbore, the inclination angle of the wellbore, the azimuth angle of the wellbore, and a wellbore circumferential angle;

applying, during the hydraulic fracturing operations, a stress correction on the breakdown pressure upper bound for the wellbore based on whether the wellbore is an open hole wellbore or a cemented liner wellbore, to generate a stress-corrected upper bound breakdown pressure for the wellbore;

determining, during the hydraulic fracturing operations, the breakdown pressure for the wellbore based on the stress-corrected upper bound breakdown pressure for the wellbore, the poroelastic stress for the wellbore, and the pore pressure for the wellbore;

determining, based at least on the breakdown pressure, a horsepower level for creating a fracture geometry used in the hydraulic fracturing operations;

determining a successful placement of stimulation materials for the hydraulic fracturing operations;

determining, based at least on the breakdown pressure, a pressure rating of tubulars required for fracturing treatment; and completing the hydraulic fracturing operations using the horsepower level, the successful placement of the stimulation materials, and one or more tubulars having the pressure rating of the tubulars required for the fracturing treatment.

2. The computer-implemented method of claim 1, wherein determining the pore pressure for the wellbore comprises:

determining the pore pressure for the wellbore using a Stehfest method equation that is a function of the time duration, a distance from the wellbore in a radial direction, the injection fluid compressibility, and the poroelastic parameter.

3. The computer-implemented method of claim 2, wherein the Stehfest method equation further comprises a modified Bessel function of a second kind of order 0.

4. The computer-implemented method of claim 1, wherein determining the poroelastic stress is further based on a Composite Simpson's Rule for numerical integration.

5. The computer-implemented method of claim 1, wherein the input parameters further comprise an initial wellbore pressure, a rock permeability, a rock porosity, the injection fluid compressibility, an injection fluid viscosity, the Poisson ratio, a wellbore radius, and a distance from the wellbore in a radial direction, at the particular depth.

6. The computer-implemented method of claim 5, wherein an initial value for the distance from the wellbore in the radial direction is two and a half the wellbore radius.

7. The computer-implemented method of claim 1, wherein the wellbore is one of: (i) a deviated wellbore, or (ii) a vertical wellbore.

8. The computer-implemented method of claim 1, wherein an initial value for the time duration is a time at which the formation is expected to break after a slurry injection.

9. The computer-implemented method of claim 1, wherein an initial value for the time duration is 1000 seconds.

10. The computer-implemented method of claim 1, wherein the wellbore is either open hole or cement lined.

11. A system comprising:

one or more processors configured to perform operations comprising:

receiving input parameters for computing a breakdown pressure for a wellbore in a formation, the input parameters comprising an inclination angle of the wellbore from a vertical axis, and an azimuth angle of the wellbore relative to a maximum horizontal stress direction, at a particular depth;

determining, during hydraulic fracturing operations, a pore pressure for the wellbore based on a time duration, an injection fluid compressibility, and a poroelastic parameter;

determining a poroelastic stress for the wellbore using a poroelastic stress equation and based on the pore pressure determined for the wellbore, an empirical parameter, a pore pressure, the poroelastic parameter, a tensile strength of rock, and a Poisson ratio;

determining, during the hydraulic fracturing operations, a breakdown pressure upper bound for the wellbore based on a minimum horizontal stress and a maximum horizontal stress for the wellbore, an overburden vertical stress for the wellbore, the inclination angle of the wellbore, the azimuth angle of the wellbore, and a wellbore circumferential angle;

applying, during the hydraulic fracturing operations, a stress correction on the breakdown pressure upper bound for the wellbore based on whether the wellbore is an open hole wellbore or a cemented liner wellbore, to generate a stress-corrected upper bound breakdown pressure for the wellbore;

determining, during the hydraulic fracturing operations, the breakdown pressure for the wellbore based on the stress-corrected upper bound breakdown pressure for the wellbore, the poroelastic stress for the wellbore, and the pore pressure for the wellbore;

determining, based at least on the breakdown pressure, a horsepower level for creating a fracture geometry used in the hydraulic fracturing operations;

determining a successful placement of stimulation materials for the hydraulic fracturing operations;

determining, based at least on the breakdown pressure, a pressure rating of tubulars required for fracturing treatment; and completing the hydraulic fracturing operations using the horsepower level, the successful placement of the stimulation materials, and one or more tubulars having the pressure rating of the tubulars required for the fracturing treatment.

12. The system of claim 11, wherein determining the pore pressure for the wellbore comprises:

determining the pore pressure for the wellbore using a Stehfest method equation that is a function of the time duration, a distance from the wellbore in a radial direction, the injection fluid compressibility, and the poroelastic parameter.

13. The system of claim 12, wherein the Stehfest method equation further comprises a modified Bessel function of a second kind of order 0.

14. The system of claim 11, wherein determining the poroelastic stress is further based on a Composite Simpson's Rule for numerical integration.

15. The system of claim 11, wherein the input parameters further comprise an initial wellbore pressure, a rock permeability, a rock porosity, the injection fluid compressibility, an injection fluid viscosity, the Poisson ratio, a wellbore radius, and a distance from the wellbore in a radial direction, at the particular depth.

16. A non-transitory computer storage medium encoded with instructions that, when executed by one or more computers, cause the one or more computers to perform operations comprising:

receiving input parameters for computing a breakdown pressure for a wellbore in a formation, the input parameters comprising an inclination angle of the wellbore from a vertical axis, and an azimuth angle of the wellbore relative to a maximum horizontal stress direction, at a particular depth;

determining, during hydraulic fracturing operations, a pore pressure for the wellbore based on a time duration, an injection fluid compressibility, and a poroelastic parameter;

determining a poroelastic stress for the wellbore using a poroelastic stress equation and based on the pore pressure determined for the wellbore, an empirical parameter, a pore pressure, the poroelastic parameter, a tensile strength of rock, and a Poisson ratio;

determining, during the hydraulic fracturing operations, a breakdown pressure upper bound for the wellbore based on a minimum horizontal stress and a maximum horizontal stress for the wellbore, an overburden vertical stress for the wellbore, the inclination angle of the wellbore, the azimuth angle of the wellbore, and a wellbore circumferential angle;

applying, during the hydraulic fracturing operations, a stress correction on the breakdown pressure upper bound for the wellbore based on whether the wellbore is an open hole wellbore or a cemented liner wellbore, to generate a stress-corrected upper bound breakdown pressure for the wellbore;

determining, during the hydraulic fracturing operations, the breakdown pressure for the wellbore based on the stress-corrected upper bound breakdown pressure for the wellbore, the poroelastic stress for the wellbore, and the pore pressure for the wellbore;

determining, based at least on the breakdown pressure, a horsepower level for creating a fracture geometry used in the hydraulic fracturing operations;

determining a successful placement of stimulation materials for the hydraulic fracturing operations;

determining, based at least on the breakdown pressure, a pressure rating of tubulars required for fracturing treatment; and completing the hydraulic fracturing operations using the horsepower level, the successful placement of the stimulation materials, and one or more tubulars having the pressure rating of the tubulars required for the fracturing treatment.

17. The non-transitory computer storage medium of claim 16, wherein determining the pore pressure for the wellbore comprises:

determining the pore pressure for the wellbore using a Stehfest method equation that is a function of the time duration, a distance from the wellbore in a radial direction, the injection fluid compressibility, and the poroelastic parameter.

* * * * *